US005519283A

United States Patent [19]

Opresko et al.

[11] Patent Number: 5,519,283

[45] Date of Patent: May 21, 1996

[54] INTERNAL MAGNETIC SHIELD FOR A COLOR CATHODE-RAY TUBE

[75] Inventors: Stephen T. Opresko, Lancaster; Richard LaPeruta, Jr., Lititz; Richard E. Roland, Conestoga, all of Pa.

[73] Assignee: Thomson Consumer Electronics, Inc., Indianapolis, Ind.

[21] Appl. No.: 341,924

[22] Filed: Nov. 16, 1994

[51] Int. Cl.[6] ..... H01J 29/06; H01J 29/94

[52] U.S. Cl. ..... 313/479; 313/402; 313/481; 313/553

[58] Field of Search ..... 313/402, 479, 313/404, 407, 477 HC, 481, 553, 558, 559; 417/48, 51; 174/35 MS

[56] References Cited

U.S. PATENT DOCUMENTS

| | | | |
|---|---|---|---|
| 3,979,633 | 9/1976 | Davis et al. | 313/481 X |
| 4,019,085 | 4/1977 | Sakata | 313/402 |
| 4,342,662 | 9/1982 | Kimura et al. | 252/181.4 |
| 4,580,076 | 4/1986 | Shimoma et al. | 313/402 |
| 4,614,896 | 9/1986 | Josephs et al. | 313/481 |
| 4,622,490 | 11/1986 | Benway | 313/481 X |
| 4,771,214 | 9/1988 | Takenake et al. | 313/481 X |
| 5,397,958 | 3/1995 | Na | 313/402 |

*Primary Examiner*—Sandra L. O'Shea
*Assistant Examiner*—Ashok Patel
*Attorney, Agent, or Firm*—Joseph S. Tripoli; Dennis H. Irlbeck; Vincent J. Coughlin, Jr.

[57] ABSTRACT

The present invention relates to a CRT 10 having an evacuated envelope comprising a funnel 11 sealed at one end to a faceplate panel 12 with a luminescent screen 14 on an interior surface thereof. A color selection electrode 16, mounted on a frame 19, is disposed within the envelope in proximity to the screen. An internal magnetic shield 22, is secured to the frame of the color selection electrode, and is spaced from and extends along at least a portion of the funnel. The magnetic shield has a plurality of openings 32 therethrough. An evaporable getter 28 is disposed within the envelope adjacent to the exterior surface 26 of the magnetic shield 22. The magnetic shield is improved by having tabs or louvers 36, 38, 136, 138, associated with the openings, for restricting the deposition of a film of getter material 30 to the exterior surface 26 of the shield 22. In a second embodiment, two magnetic shields 122, 222, with openings 132 and 232, respectively are attached to the frame 19 of the color selection electrode 16. The openings 132 and 232 are non-aligned, thereby restricting the getter film to the exterior surfaces to the two magnetic shields.

8 Claims, 4 Drawing Sheets

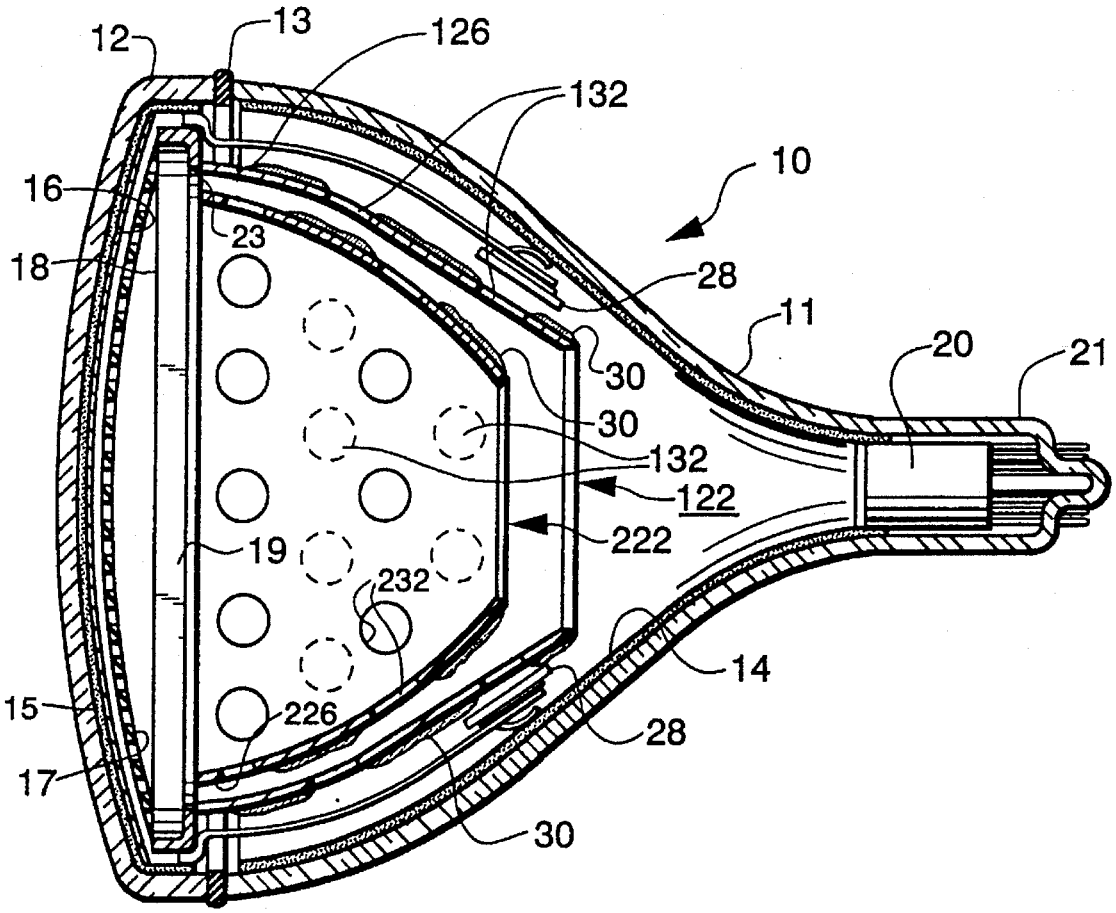
12
13
126
132
10
16
23
18
28
11
20
21
30
30
132
122
222
19
232
14
15
226
28
17
30

INTERNAL MAGNETIC SHIELD FOR A COLOR CATHODE-RAY TUBE

The present invention relates to a color cathode-ray tube (CRT) having an internal magnetic shield and, more particularly, to an internal magnetic shield having means for restricting the deposition of a film of getter material to the exterior surface thereof.

BACKGROUND OF THE INVENTION

A color CRT includes an evacuated glass envelope comprising a rectangular faceplate panel and a tubular neck connected by a funnel. An electron gun is located within the neck for generating and directing a plurality of electron beams through openings in a color selection electrode, such as a shadow mask or a focus mask, that is located in proximity to a luminescent screen provided on an interior surface of the faceplate panel. The color selection electrode is attached to a frame that is supported by springs which engage mounting studs that extend inwardly from the faceplate panel of the tube. A thin conductive layer, preferably of aluminum, overlies the screen and provides a mean to apply a uniform potential thereto. An internal magnetic shield, made of thin, cold-rolled steel, is fastened to the frame which is attached to the color selection electrode. The primary purpose of the magnetic shield is to reduce the influence of magnetic fields on electron beam trajectories as the luminescent screen of the tube is scanned by the electron beams. In particular, the angles of incidence of the electron beams at every point on the shadow mask must not change significantly from the design values. Otherwise, the beams will move away from the intended landing positions on the screen. The internal magnetic shield is designed to fit into the funnel and to be as close to the funnel wall as possible, without contacting a conductive coating on the interior surface of the funnel wall.

The CRT utilizes a flashable getter to provide an internal deposit, or film, of gas-adsorbing material essential for adequate life of the CRT. It is desirable that the getter deposit not be provided on an interior surface of the color selection electrode or on the luminescent screen. Getter deposits on the interior surface of the color selection electrode are undesirable because such deposits may overlie heat dissipative and/or X-ray suppressing coatings provided thereon, thus interfering with the operations of the coatings. Additionally, portions of a getter deposit directed onto the interior surface of the color selection electrode will pass through the apertures or openings therein and be deposited on portions of the aluminum layer overlying the luminescent screen. The getter material on the aluminum layer absorbs energy from the electron beams incident thereon, causing a decrease in screen brightness in the underlying areas of the screen. This results in an objectionable non-uniform appearance of the screen. To prevent the flashed getter material from being deposited onto the interior surface of the color selection electrode and the screen, it is known to locate the getter in proximity to an exterior surface of the internal magnetic shield, in order to restrict the deposit of the flashed, gas-adsorbing getter material to the exterior surface of the magnetic shield.

Internal magnetic shields may have any number of configurations, including substantially imperforate structures, or structures having open areas therein. The primary requirement, regardless of configuration, is that the internal magnetic shield provide magnetic shielding of the electron beams passing therewithin. Where the external surface of the internal magnetic shield also is used to support a deposit of the flashed getter material, care must be taken to ensure that none of the flashed getter material passes into the interior of the internal magnetic shield where it might be deposited directly onto the interior surface of the color selection electrode and onto the screen.

While it might seem desirable to utilize an internal magnetic shield that is imperforate, in order to restrict the getter deposit to the external surface thereof, it has been determined that when the shield is imperforate, a getter film deposited on the exterior surface is not readily accessible to the gas molecules within the tube. Consequently, an increase in localized gas pressure occurs, and positively charge ions are generated by the collision between the electron beams and the gas molecules within the tube. The positively charged ions are accelerated toward the cathodes of the electron gun, where they bombard and deplete the cathode coatings, resulting in the reduction of cathode emission. Thus, it is desired to have an internal magnetic shield structure that provides an exterior surface onto which the flashed getter material can be deposited, without allowing the getter material to pass into shield and onto the interior surface of the color selection electrode and the screen. The internal magnetic shield also must permit the gas molecules within the tube to readily reach the getter deposits on the exterior surface thereof, so that there is no deleterious effect on cathode emission.

SUMMARY OF THE INVENTION

The present invention relates to a CRT having an evacuated envelope comprising a funnel sealed at one end to a faceplate panel. A luminescent screen is provided on an interior surface of the panel. A color selection electrode, mounted on a frame, is disposed within the envelope in proximity to the screen. An internal magnetic shield is secured to the frame of the color selection electrode, and is spaced from and extends along at least a portion of the funnel. The magnetic shield has an interior and an exterior surface, with a plurality of openings therethrough. An evaporable getter is disposed within the envelope adjacent to the exterior surface of the magnetic shield. The magnetic shield is improved by having means, associated with the openings therethrough, for restricting the deposition of a getter film to the exterior surface of the shield.

BRIEF DESCRIPTION OF THE DRAWINGS

The invention will now be described in greater detail, with relation to the accompanying drawings, in which:

FIG. 6 is a plan view, partially in axial section, of a color CRT containing a second embodiment of the present invention.

DETAILED DESCRIPTION OF THE PREFERRED EMBODIMENTS

Figure 1:
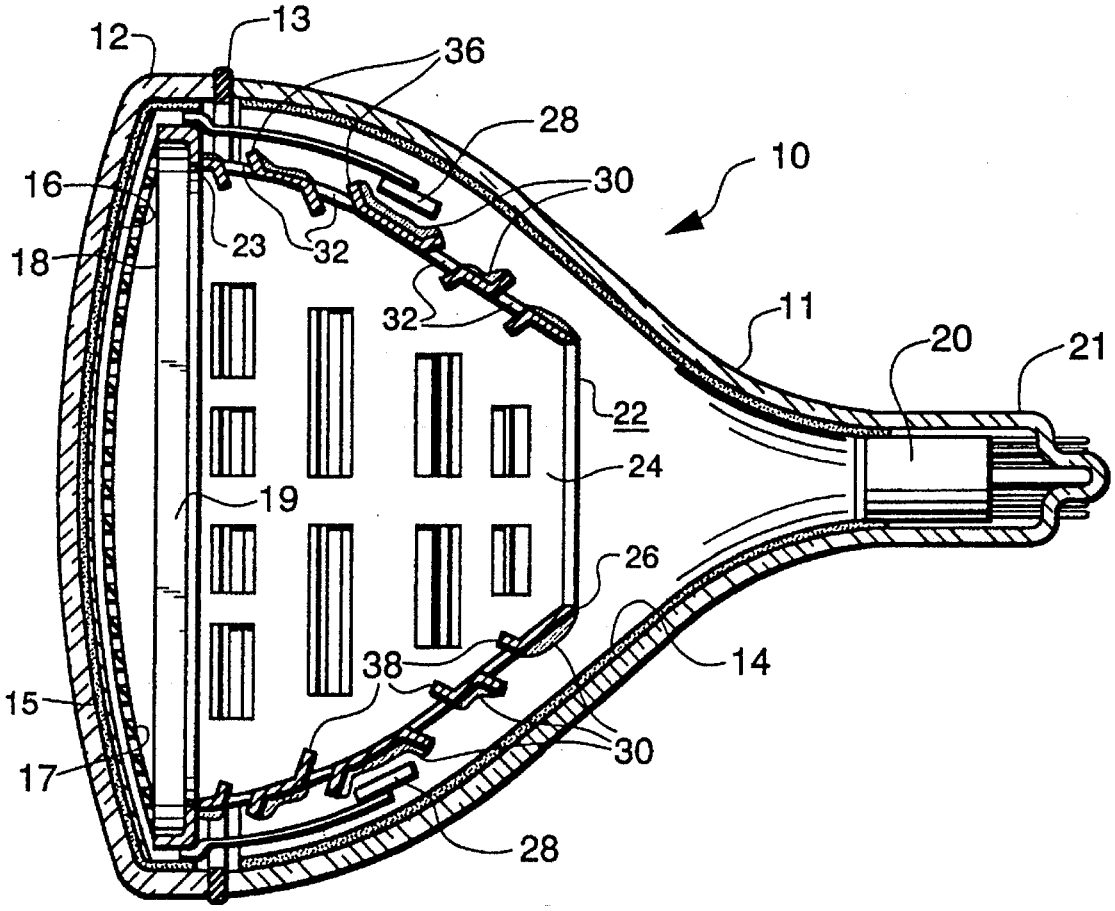
FIG. 1 is a plan view, partially in axial section, of a color CRT made according to the present invention.

FIG. 1 shows a color CRT 10 that includes a funnel 11 and a substantially rectangular glass faceplate panel 12 which are sealed by a frit seal 13. A conductive coating 14 is provided on the interior surface of the funnel 11. A luminescent phosphor screen 15 is provided on an interior surface of the faceplate panel. The phosphor screen 15 is composed of triads of phosphor elements each of which emits light in one of the three primary colors, red, blue, and green, when impacted by one of three electron beams. Preferably, the phosphor screen is a line screen with the phosphor lines extending substantially perpendicular to the high frequency raster line scan of the CRT (normal to the plane of FIG. 1). Alternatively, the screen may be a dot screen. A thin conductive layer 16, preferably of aluminum, overlies the screen 15 and provides a means to apply a uniform potential thereto. A color selection electrode 17, such as a focus mask or a conventional shadow mask, is mounted, or otherwise secured, to one surface 18 of a frame 19. The color selection electrode 17 is conventionally secured within the faceplate panel 12, in proximity to the screen 15, and is used to direct the three electron beams to the phosphor elements that emit the appropriate colors of light. The openings in the color selection electrode 17 correspond to the shape of the phosphor screen elements. For example, if the screen is a line screen, and the color selection electrode 17 is a shadow mask, then the aperture openings in the mask are rectangular slots, and if the screen is a dot screen, the mask apertures are circular openings. An electron gun 20 is arranged in a neck portion 21 of the funnel 11 to generate and direct three electron beams toward the screen 15 to scan the phosphor elements thereof.

The electrons within the beams are charged particles. Accordingly, the electron beams are subject to deflection because of the influence of the earth's magnetic field. The effects of the earth's magnetic field are minimized by an internal magnetic shield (IMS) 22 that is attached to another surface 23 of the frame 19. The shield 22 has an interior surface 24 and an exterior surface 26 that is spaced from and extends along at least a portion of the funnel 11. The color selection electrode 17, the frame 19 and the IMS 22 are composed of ferromagnetic material, such as cold-rolled AK steel, low carbon steel, or an iron-nickel alloy that has a lower coefficient of thermal expansion than the other named materials. These ferromagnetic components bend or redirect the magnetic field lines of the earth around the electron beams to minimize the effects on the beams as they pass within the shield 22 and through the apertures in the color selection electrode 17. This is an important feature because the bending of the electron beams, due to the earth's magnetic field, can cause a particular electron beam to impact on a phosphor element of the wrong light-emitting color, thus resulting in misregistry, thereby degrading the quality of the image display.

A least one, and preferably two or more, evapotable, or flashable, getter devices 28 are located within the envelope 11, adjacent to the exterior surface 26 of the shield 22, to provide a film, or deposit, 30 of gas-adsorbing material, the thickness of which is exaggerated in FIG. 1. The getter film 30 maintains a sufficiently low pressure within the CRT 10 by adsorbing the residual gas molecules therein. This low pressure within the envelope is essential for adequate life of the CRT 10. To ensure that the film 30 is readily accessible to the residual gas molecules within the CRT 10, a plurality of openings 32 are formed between the exterior surface 26 and the interior surface 24 of the shield 22. The openings 32 of FIG. 1 are formed by lancing the body of the shield 22 at a number of locations, shown in FIGS. 2 and 3, with "H-shaped" slits 34, and bending the shield material, above and below the transverse portion of the slit 34, out of the plane of the shield to forms tabs 36 and 38. The tabs 36 and 38, shown in FIG. 1, are bent to intercept the path of the evaporated material from the getter 28, and to prevent the deposition of the getter film 30 within the shield 22, by blocking the line-of-sight path between the getter 28 and the interior of the shield. This is accomplished by bending the tabs 36 outwardly toward the getter 28, and the tabs 38 inwardly away from the getter. The getter film 30 is thus restricted to the exterior surface of the shield 22, while the openings 32 provide access to the getter film for the gas molecules within the tube.

Figure 2:
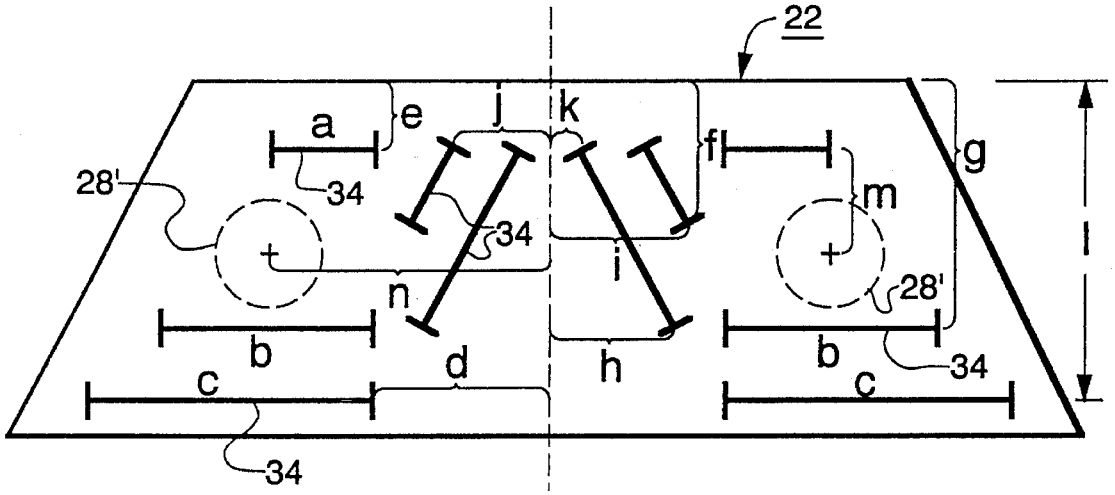
FIG. 2 is a schematic view of the long side of a magnetic shield made according to the present invention, showing one possible set of locations for mask openings in the long side.
Figure 3:
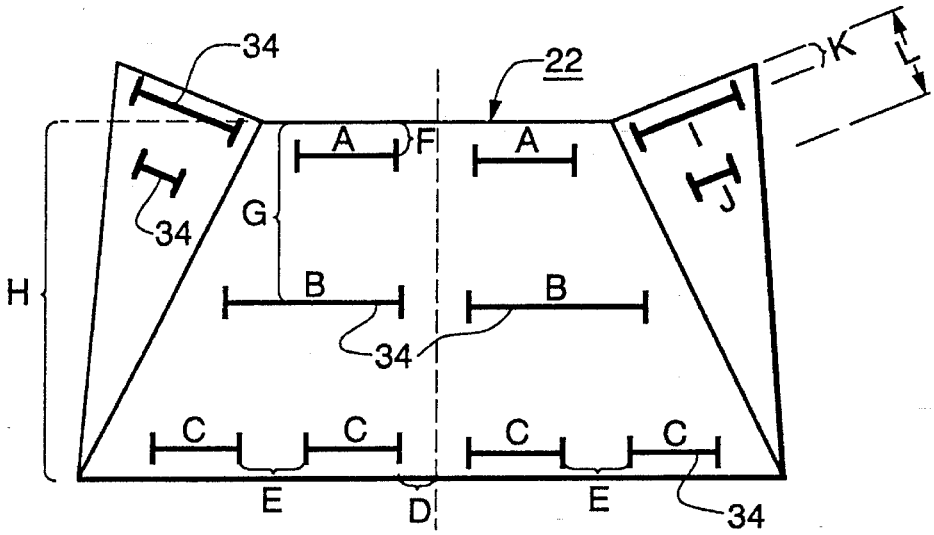
FIG. 3 is a schematic view of the short side and corners of the magnetic shield of FIG. 2, showing one possible set of locations for mask openings in the short side and corners.

The slit locations and dimensions for the preferred embodiment are shown in FIGS. 2 and 3. FIG. 2 shows one long side of the shield 22, and FIG. 3 shows one short side and the adjacent corners of the shield. The opposite sides of the shield that are not shown are the same as those shown. FIG. 2 also shows projections 28' of the getters 28 on the long side of the shield 22. The sides and locations of the slits shown in the figures are merely exemplary, and any changes in either the number, size and/or the location of the slits, that satisfy the purposes of the shield structure, are within the scope of the present invention. With reference to FIG. 2, the slit dimensions and locations for the long sides of the shield 22 are listed in TABLE I. All dimensions listed in TABLE I are in millimeters.

TABLE I

| SYMBOL | DIMENSION |
|---|---|
| a | 50 |
| b | 100 |
| c | 120 |
| d | 85 |
| e | 20 |
| f | 50 |
| g | 85 |
| h | 60 |
| i | 75 |
| j | 50 |
| k | 20 |
| l | 110 |
| m | 30 |
| n | 130 |

With reference of FIG. 3, the slit dimensions and locations for the short sides and the corners of the shield 22 are listed in TABLE II. All dimensions are in millimeters.

TABLE II

| SYMBOL | DIMENSION |
|---|---|
| A | 50 |
| B | 90 |
| C | 45 |
| D | 15 |
| E | 30 |
| F | 20 |
| G | 60 |
| H | 100 |
| I | 60 |
| J | 30 |

TABLE II-continued

| SYMBOL | DIMENSION |
|---|---|
| K | 10 |
| L | 40 |

In the embodiment of FIG. 1, the total area of the openings 32 typically ranges from about 5 to 25 percent of the total area of the shield 22.

Figure 4:
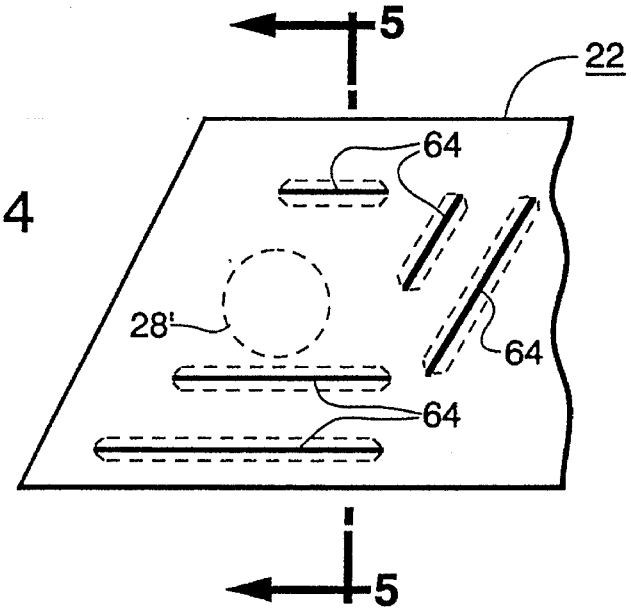
FIG. 4 is a schematic view of a portion of the long side of a magnetic shield made according to the present invention, indicating the location of the mask openings and showing, in phantom, the associated louvers.
Figure 5:
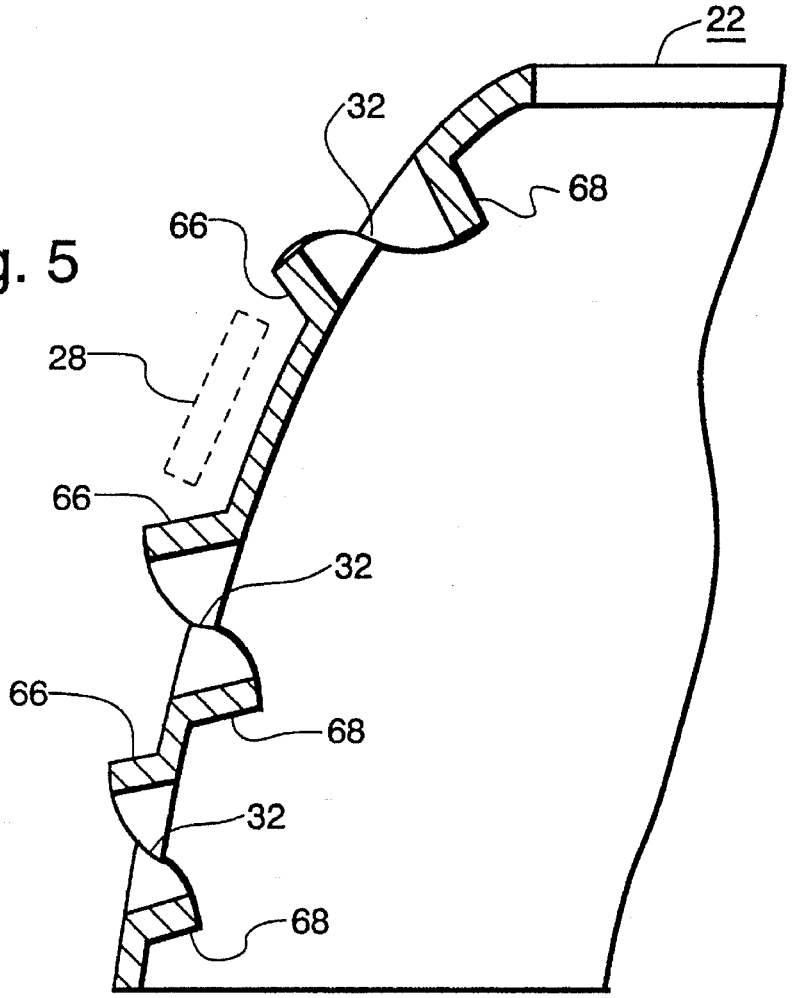
FIG. 5 is an enlarged cross-sectional view of the shield taken along line 5—5 of FIG. 4, after the louvers and openings have been formed therein.

FIGS. 4 and 5 show an alternative method of forming the openings 32 of FIG. 1. In FIG. 4, a plurality of slits 64 are provided through the shield 22. The body of the shield, in the areas indicated by the dashed lines above and below the slits 64, is bent out of the plane of the shield to form outwardly directed louvers 66 and inwardly directed louvers 68, shown in FIG. 5. Also shown in FIG. 4 is a projection 28' of the getter 28, which is shown in phantom in FIG. 5. Again with reference to FIG. 5, the louvers 66 and 68 differ from the tabs 36 and 38 in that the louvers are tapered at the ends and blend into the body of the shield 22.

A second embodiment of the present invention is shown in FIG. 6. Those structural elements of the second embodiment that are identical to the corresponding elements in FIG. 1 bear the same identifying numbers and are not described. Again with respect to FIG. 6, the means for restricting the getter film 30 so that it cannot be deposited onto the interior surface of either the color selection electrode 17 or the screen 15 comprises a first magnetic shield 122 that is attached to the surface 23 of the frame 19, and a second magnetic shield 222 that is disposed within the first shield 122. The first shield 122 has a plurality of openings 132 formed therethrough. While the openings 132 are shown as circular apertures, any shape openings are within the scope of the invention. The second shield 222 is shown as being attached to the surface 23 of the frame 19; however, the second shield may also be attached to the first shield 122. The second shield 222 has a plurality of openings 232 therethrough. The openings 232 are located so that they are not aligned with the openings 132 in the first shield 122. The misalignment of the openings 132 and 232 ensures that the getter film 30 will be restricted to the exterior surfaces 126 and 226, respectively, of the shields 122 and 222, and cannot pass into the interior of the second shield 222 to be deposited onto either the interior of the shadow color selection electrode 17 or the screen 15.

In the embodiment of FIG. 6, the area of each of the openings 132 and 232 is about 1.25 to 4.0 square centimeters, and the total area of the openings ranges from about 5 to 25 percent of the total area of the shields 122 and 222.

What is claimed is:

1. In a color cathode-ray tube having an evacuated envelope comprising:

a funnel sealed at one end to a faceplate panel with a luminescent screen on an interior surface thereof;

a color selection electrode mounted on a frame disposed within said envelope, in proximity to said screen;

a magnetic shield secured to said frame of said color selection electrode, said magnetic shield being spaced from and extending along at least a portion of said funnel, said magnetic shield having a body including an interior and an exterior surface, with a plurality of openings therethrough;

and an evaporable getter device within said envelope, said evapotable getter device being disposed adjacent to said exterior surface of said magnetic shield; the improvement wherein said magnetic shield comprises restricting means, associated with said openings, for restricting the deposition of a film of getter material to said exterior surface of said shield, the restricting means including at least an element within said magnetic shield.

2. The tube as described in claim 1, wherein the restricting means comprise a plurality of inwardly directed first tabs being formed from said body of said shield adjacent to said openings for intercepting said getter material.

3. The tube as described in claim 2, wherein the restricting means further comprise a plurality of outwardly directed second tabs being formed from said body of said shield adjacent to said openings for intercepting said getter material.

4. The tube as described in claim 1, wherein the restricting means comprise a plurality of inwardly directed first louvers being formed from said body of said shield adjacent to said openings for intercepting said getter material.

5. The tube as described in claim 2, wherein the total area of said openings is about 5 to 25 percent of the total area of said shield.

6. The tube as described in claim 1, wherein the restricting means comprises a second magnetic shield disposed within said magnetic shield, said second magnetic shield having an interior surface and an exterior surface, with a plurality of openings therethrough, said openings in said shields being non-aligned, thereby restricting said getter film to said exterior surfaces of said shields.

7. The tube as described in claim 6, wherein each of said openings in said shields has an area of about 1.25 and 4.0 $cm^2$, and the total area of said openings is about 5 to 25 percent of the total area of said shields.

8. The tube as described in claim 4, wherein the restricting means further comprise a plurality of outwardly directed second louvers being formed from said body of said shield adjacent to said openings for intercepting said getter material.

* * * * *